US005692304A

United States Patent [19]

Campbell

[11] Patent Number: 5,692,304

[45] Date of Patent: Dec. 2, 1997

[54] LOCKING DEVICE FOR FOLDING TOOL

[75] Inventor: Ivory Joe Campbell, Statesboro, Ga.

[73] Assignee: Cooper Industries, Inc., Houston, Tex.

[21] Appl. No.: 683,438

[22] Filed: Jul. 19, 1996

[51] Int. Cl.[6] ..... B26B 1/02

[52] U.S. Cl. ..... 30/161; 30/155

[58] Field of Search ..... 30/158, 159, 160, 30/161, 155; 7/128, 168

[56] References Cited

U.S. PATENT DOCUMENTS

| | | | |
|---|---|---|---|
| 234,378 | 11/1880 | Pierce . | |
| 401,549 | 4/1889 | Gemrig | 30/160 |
| 469,783 | 3/1892 | Graves . | |
| 916,426 | 3/1909 | Evens . | |
| 998,068 | 3/1911 | Beardsley et al. . | |
| 999,060 | 7/1911 | Schrade . | |
| 1,169,000 | 1/1916 | Brown | 30/161 |
| 2,263,415 | 11/1941 | Berg et al. | 30/160 |
| 3,783,509 | 1/1974 | Lake | 30/161 |
| 4,238,802 | 12/1980 | Leatherman | 7/128 |
| 4,502,221 | 3/1985 | Pittman | 30/161 |
| 4,703,560 | 11/1987 | Brooker | 30/161 |
| 4,744,272 | 5/1988 | Leatherman | 30/153 |
| 4,888,869 | 12/1989 | Leatherman | 30/161 |
| 4,985,998 | 1/1991 | Howard | 30/160 |
| 5,095,624 | 3/1992 | Ennis | 30/161 |
| 5,125,157 | 6/1992 | Howard | 30/161 |
| 5,142,721 | 9/1992 | Sessions et al. | 30/162 |
| 5,212,844 | 5/1993 | Sessions et al. | 30/162 |
| 5,442,855 | 8/1995 | Jobin | 30/161 |
| 5,490,332 | 2/1996 | Levin | 30/161 |

FOREIGN PATENT DOCUMENTS

| | | | |
|---|---|---|---|
| 0 100 377 | 2/1984 | European Pat. Off. . | |
| 2254433 | 5/1974 | Germany | 30/161 |

*Primary Examiner*—Hwei-Siu Payer

*Attorney, Agent, or Firm*—Burns, Doane, Swecker & Mathis LLP

[57] ABSTRACT

A locking device for a folding tool includes a spring member extending from a handle over a tool hub. The hub is formed with a notch shaped with obliquely directed sides and a stop wall spaced from the notch. The portion of the hub including the notch and the stop wall forms a bearing surface. The spring member includes a v-shaped bend that substantially matches the notch and a finger extending from the bend. In an extended position, the tool is secured by the engagement of the bend in the notch and the abutment of the finger on the hub on the bearing surface and stop wall.

8 Claims, 2 Drawing Sheets

LOCKING DEVICE FOR FOLDING TOOL

FIELD OF THE INVENTION

The invention is directed to devices having a hollow handle and a tool element that is folded in the handle for storage and unfolded to an extended position for use. More particularly, the invention is directed to a spring locking device for a folding tool.

BACKGROUND AND SUMMARY

Folding tools, for example, pocket knives or multipurpose tools having knife blades, screw driver bits and the like, include some type of locking device to secure one of the tools in a working position extended from the handle. Conventional locking devices include a flat spring member that engages a flat portion of the tool. Other devices include a spring with a small stud that fits into a notch in the tool. Typically, the stud is disposed at the end of the spring member and locking contact is made between the stud and the notch. In such conventional devices, substantially all of the locking force is applied at a single point where the stud fits into the notch. In addition, the stud also serves as a stop to prevent rotation of the tool past the operative position. The stud and notch are typically square or feet angularly shaped, and repeated passage of the stud over the sharp edge of the notch causes wear to both the stud and notch.

The present invention provides an improved locking device for a folding tool. The locking device according to the invention includes a spring member having a bearing surface that is shaped to match a locking surface of a tool hub. Pivoting movement of the tool brings the locking surface into engagement with the bearing surface of the spring. The bearing surface exerts a force on the locking surface to secure the tool in place.

According to the invention, the bearing surface includes a protrusion formed in the spring member. A free end extends from the protrusion to act as a stop member, thus separating the stop member from the locking member of the spring. The locking surface is formed on the periphery of the hub and has a recess matching the shape of the protrusion of the spring member. A stop edge is formed in the hub spaced from the recess a predetermined distance. When the bearing surface engages the locking surface, the protrusion fits into the recess and the free end of the spring member bears on the hub surface with the end edge abutting the stop edge.

According to a preferred embodiment, the protrusion is v-shaped and the notch is correspondingly shaped. The sides of the notch are oblique to the longitudinal axis of the tool, so that when the protrusion is acting on the notch, the resultant force exerted has a first force component acting toward the pivot point and a second force component acting toward the handle. In addition, the v-shaped protrusion provides a relatively large contact area through which force is applied to the tool to prevent rotation. The large contact area distributes locking force over a large surface area of the hub, which improves the locking function and reduces wear on the protrusion and notch.

According to a preferred embodiment of the invention, the spring member is a leaf spring and the protrusion is formed by a v-shaped bend in the spring member. The recess is correspondingly wedge shaped.

According to the invention, the profile defined by the bearing surface of the spring is substantially identical to a profile defined by a portion of the hub including the recess and the stop edge. The close firing, mating contact between the surface of the v-shaped bend and the notch in the hub ensures the distribution of the securing force over a relatively broad area, which results in improved locking of the tool.

BRIEF DESCRIPTION OF THE DRAWINGS

The invention will become better understood by reference to the following detailed description in conjunction with the appended drawings, in which.

DETAILED DESCRIPTION

Figure 1:
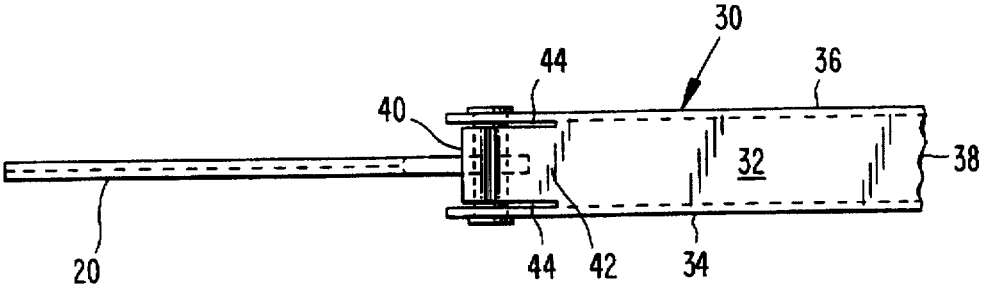
FIG. 1 is a top view of a folding tool in accordance with the invention showing a tool member and a portion of a handle.

A tool according to the invention is illustrated in a top view in FIG. 1. The tool includes a tool member 20 and a handle 30. The handle 30 includes an interior space 32 enclosed by opposed side wails 34, 36 and a bottom wall 38.

Figure 2:
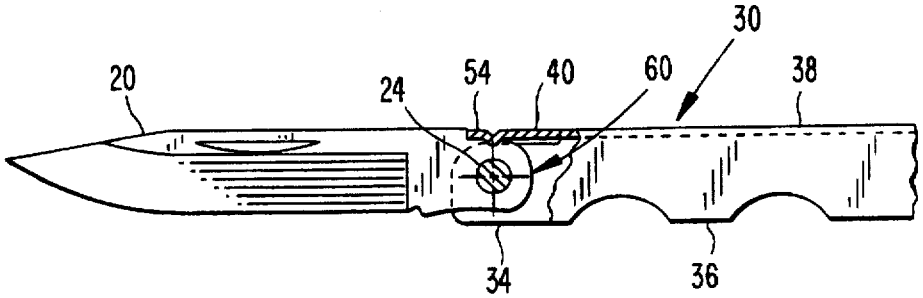
FIG. 2 is a side view of the folding tool of FIG. 1 showing a tool member in an extended position for use.
Figure 3:
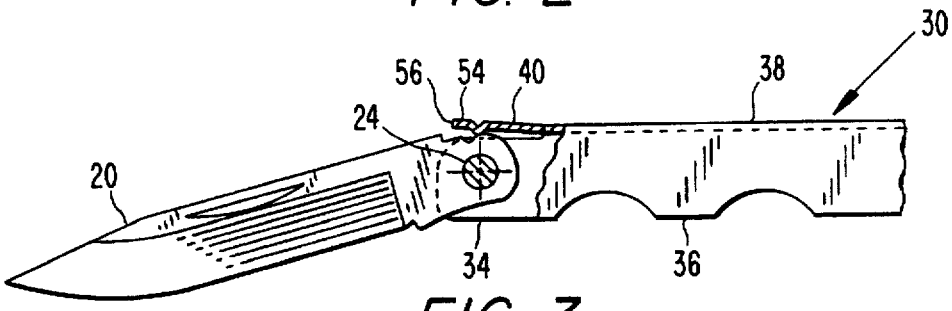
FIG. 3 is a side view of the folding tool of FIG. 1 showing the tool member pivoted from the extended position.

The tool member 20 includes a hub 60 by which it is attached to the handle 30 at a pivot 24. The tool member 20 may be a knife blade (as illustrated) or another tool, for example, a screw driver bit, a file blade, or a can-opener. The pivot 24 allows the tool member 20 to pivot between a position extended and substantially aligned with the handle 30, as shown in FIG. 2, and folded for storage into the interior space 32 of the handle, which is not illustrated, but may be easily understood.

A free portion of the bottom wall 38 extends over the pivot 24, that is, the free portion is separated from the side walls 34, 36 by cuts 44 and, therefore, is free to move relative to the bottom wall 38. The free portion forms a plate or leaf spring member 40 resiliently deflectable about joint 42 that acts on pivot 24 to resist rotation of the tool 20 about the pivot lock the tool in the extended position (FIG. 2) and in the folded position.

The spring member 40 is substantially co-planar with the bottom wall 38 and is in position for contact with the tool 20.

The spring member 40 includes a first portion 50, substantially co-planar with the bottom wall 38, extending from the joint 42. A protrusion 52 extending toward the pivot 24 is formed in the spring member 40 a distance from the joint 42. In a preferred embodiment, the protrusion 52 is a v-shaped bend in the plate with the convex side directed toward the pivot 24. A bend is easily formable in the spring 40 at an appropriate depth and width. The protrusion 52 may alternatively be formed by a wedge-shaped element welded or otherwise bonded to the spring 40. A free end portion 54, or finger, of the spring 40 extends from the protrusion 52 a predetermined distance opposite the first portion 50 and terminates in a free end edge 56. The free end portion 54 is substantially co-planar with the bottom wall 38. The surface of the spring facing the tool 20 including the protrusion 52 forms a bearing surface which acts on the hub 60 to resist rotation of the tool and provides a locking force on the tool to secure the tool in the extended position.

Figure 4:
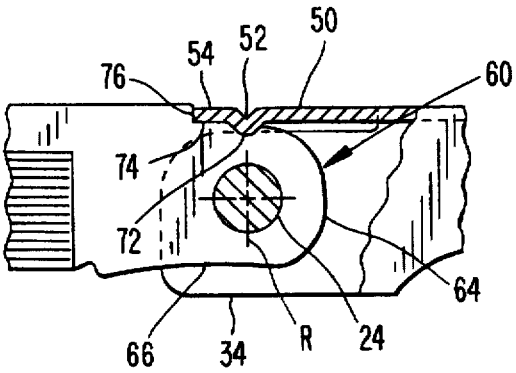
FIG. 4 is an enlarged view of the folding tool in the position illustrated in FIG. 2, showing a pivot attachment of the tool and handle and details of the locking device in accordance with the invention.

The tool hub 60 includes a generally cylindrical hub surface surrounding the pivot 24. The hub surface includes a substantially semi-circular crown 64 at an axial end of the tool 20. A first side 66 of the hub 60 is flat or preferably slightly concave and is substantially parallel to a longitudinal axis of the tool 20, as shown in FIG. 4. The first side 66 is engaged by the spring member 40 when the tool 20 is in the folded position in the interior space 32 of the handle. The spring member 40 provides resistance to pivoting movement moving the tool 20 from the interior space 32.

A second side of the hub 60 opposite the first side 66 includes a recess or notch 72 shaped to match the protrusion 52 in the spring member 40. The second side includes a flat portion 74, substantially parallel to the tool longitudinal axis, extending from the notch 72 opposite the crown 64. A stop edge 76 is formed at the end of the flat portion 74 and is substantially perpendicular to the flat portion 74.

As seen in FIG. 4, when the tool 20 is in the extended position, the protrusion 52 fits closely in the notch 72, the free end portion 54 fits against the flat portion 74, and the end edge 56 abuts the stop wall 76. The bearing surface of the protrusion 52 acts on the hub notch 72 so that the spring force exerted resists movement pivoting the tool 20 from 30 the extended position. The free end edge 56 abutting the stop wall 76 and the free portion 54 acting on the flat portion 74 of the hub act to prevent rotation of the tool 20 beyond the extended working position.

The notch 72 is approximately centered on a radius R from the pivot 24 center. The notch walls are oriented obliquely to the longitudinal axis of the tool 20. Thus, a first component of the force exerted on the notch by the protrusion is directed to the pivot 24 and a second component is directed along the longitudinal axis of the tool from the pivot 24. Any rotational movement of the tool must overcome these force components.

Figure 6:
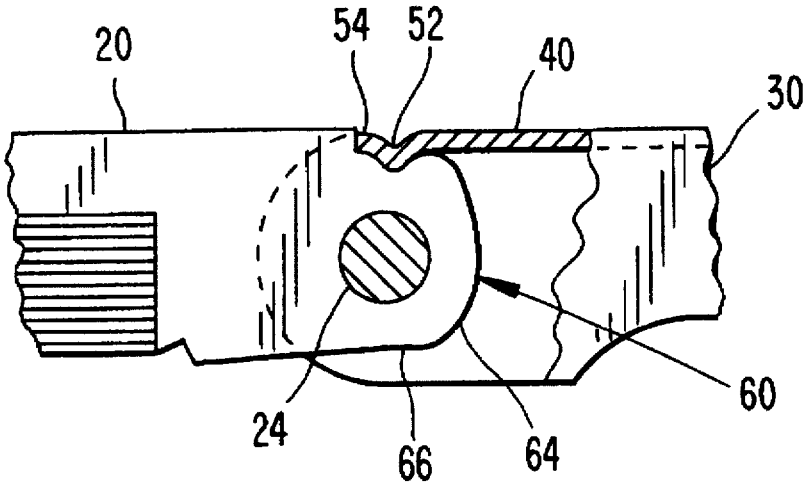
FIG. 6 is an enlarged view of a pivot attachment of a tool and handle for an alternative embodiment of the locking device of the invention.
Figure 7:
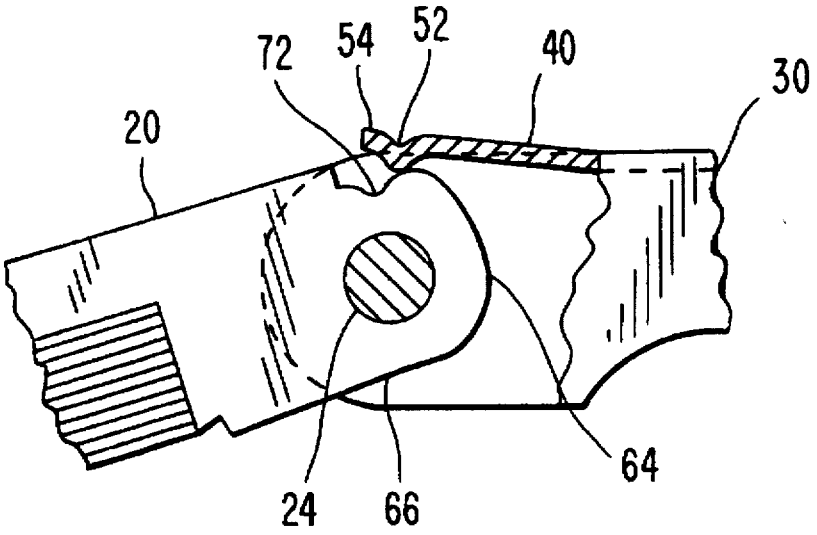
FIG. 7 is an enlarged view of the tool of FIG. 6 with the tool slightly pivoted from the locked position.

According to an alternative embodiment, illustrated in FIG. 6 and FIG. 7, the recess 72 is offset an axial distance from the pivot 24 toward the hub crown 64. This arrangement provides an increased lever arm for the force component acting toward the pivot point 24, and thus increases the force resisting rotation of the tool.

Figure 5:
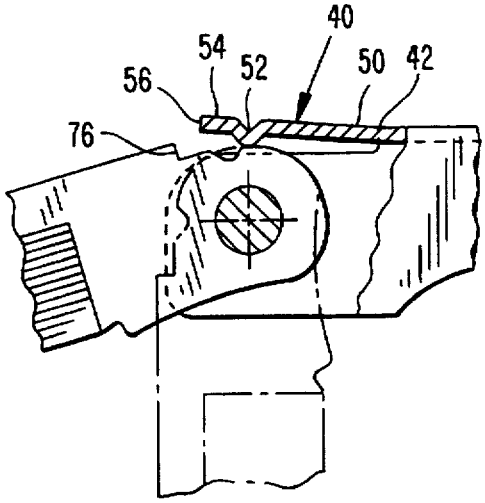
FIG. 5 is an enlarged view similar to FIG. 4, showing the tool slightly pivoted from the extended position.

As illustrated in FIG. 5 and FIG. 7, when the tool is rotated from the extended position, the protrusion 52 slides on the wall of the notch 72 until it is lifted from the notch 72 onto the hub crown 64. The spring member 40 is increasingly deflected through this movement, which requires the application of force on the spring. The spring resists movement lifting the protrusion 52 along the notch wall and out of the notch 72. Because the notch wall slants toward pivot point, the spring acts to urge the tool 20 to the extended position while the protrusion 52 is in contact with the notch 72, that is, until the protrusion is lifted onto the crown 64.

Further rotation of the tool 20 rotates the crown 64 under the protrusion 52 of the spring member 40 (shown by the broken-line tool). Continued rotation moves the tool to the position in the interior space 32 of the handle where the spring 40 and protrusion 52 act on the first portion 66. The concavity of the first portion 66 relieves some of the deflection and spring force in the spring member 40. The force required to rotate the tool 20 to lift the protrusion 52 onto the hub crown 64 from the first portion 66 helps to maintain the tool 20 in the interior of the handle 30.

The invention has been described in terms of the illustrated embodiments, however, one skilled in the art will understand that the invention may be practiced other than as specifically described without departing from the scope of the invention as defined in the claims.

What is claimed is:

1. A folding tool, comprising:

a handle having a longitudinal axis and an interior space;

a tool element having a longitudinal axis and attached at a pivot to the handle, the tool element being pivotable between a position in the interior space and an extended position wherein the longitudinal axis of the tool element is substantially aligned with the longitudinal axis of the handle, the tool element a hub through which the pivot is positioned, the hub having a surface radially surrounding the pivot, the surface having a v-shaped recess and a stop wall longitudinally spaced from the recess; and a leaf spring member attached to the handle and substantially parallel to the longitudinal axis of the handle, the spring member ha ring a free end portion biased for frictional contact with the hub of the tool element, and having a v-shaped bend longitudinally spaced from an end edge and directed toward the recess, the v-shaped bend substantially matching the recess, wherein the leaf spring member bears on the hub with the v-shaped bend in the recess and the end edge abutting the stop wall to secure the tool element in the extended position.

2. The folding tool as claimed in claim 1, wherein the recess is positioned so that a line perpendicular to the axis and passing through a center of the recess is aligned with a line perpendicular to the axis and passing through the pivot.

3. The folding tool as claimed in claim 1, wherein the recess is positioned so that a line perpendicular to the axis and passing through a center of the recess is axially offset toward a crown of the hub relative to a line perpendicular to the axis and passing through the pivot.

4. A folding tool, comprising:

a handle having an interior space;

a tool element having a hub, pivotally connected at the hub to the handle for pivoting movement from a position in the interior space of the handle to a working position outside the interior space, the hub having a generally semi-cylindrical outer surface with a v-shaped notch and a stop wall spaced a predetermined distance from the notch; and, a plate spring attached to the handle and extending over the outer surface of the hub, the spring being biased for contact force on the hub directed toward a hub pivot, the spring having a protrusion formed by a v-shaped bend to match the notch and a finger extending from the protrusion having a length corresponding to the predetermined distance, wherein to lock the tool element in the working position the protrusion fits into and engages the notch with an end of the finger abutting the stop wall.

5. The folding tool as claimed in claim 4, wherein a portion of the outer surface including the notch and the stop wall define a shape profile substantially identical to a shape profile defined by the portion of the spring including the protrusion and the finger.

6. The folding tool as claimed in claim 4, wherein the notch is positioned so that a line perpendicular to a longitudinal axis of the tool element and passing through a center of the notch is aligned with a line perpendicular to the longitudinal axis and passing through the hub pivot.

7. The folding tool as claimed in claim 4, wherein the notch is positioned so that a line perpendicular to a longitudinal axis of the tool element and passing through a center of the notch is axially offset toward a crown of the hub relative to a line perpendicular to the longitudinal axis and passing through the hub pivot.

8. The folding tool as claimed in claim 4, wherein engagement of the end of the finger with the stop wall provides a stop to prevent further pivoting movement of the tool element from the interior space of the handle.

* * * * *

UNITED STATES PATENT AND TRADEMARK OFFICE

CERTIFICATE OF CORRECTION

PATENT NO. : 5,692,304

DATED : December 2, 1997

INVENTOR(S) : Ivory Joe Campbell

It is certified that error appears in the above-identified patent and that said Letters Patent is hereby corrected as shown below:

In Column 4, line 43, delete "ha ring" and insert --having--.

In Column 4, line 53, after "axis" insert --of the tool element--.

In Column 4, line 55, after "axis" insert --of the tool element--.

In Column 4, line 57, after "axis" insert --of the tool element--.

In Column 4, line 61, after "axis" insert --of the tool element--.

Signed and Sealed this

Fifth Day of May, 1998

Bruce Lehman

*Attest:*

BRUCE LEHMAN

*Attesting Officer*

*Commissioner of Patents and Trademarks*